US006012537A

United States Patent [19]

Rountree et al.

[11] Patent Number: 6,012,537

[45] Date of Patent: Jan. 11, 2000

[54] PRINTED CIRCUIT BOARD MOUNTING FOR OIL TOOLS

[75] Inventors: Steven P. Rountree; Terry B. Wiley, both of Lafayette, La.

[73] Assignee: Prime Directional Systems, L.L.C., Broussard, La.

[21] Appl. No.: 08/951,231

[22] Filed: Oct. 16, 1997

[51] Int. Cl.[7] ..... E21B 47/01

[52] U.S. Cl. ..... 175/40; 166/242.1

[58] Field of Search ..... 175/40, 45, 320; 166/242.1

[56] References Cited

U.S. PATENT DOCUMENTS 3,746,106 7/1973 McCullough et al. ..... 340/853.5
4,485,563 12/1984 Sharp et al. ..... 33/314
4,593,804 6/1986 Kinsey et al. ..... 193/41

OTHER PUBLICATIONS http://www.dupont.com/teflon/electric.html Mar. 1999.
Rules to follow when using DuPont Teflon(R) Brand Mar. 1999.

*Primary Examiner*—William Neuder
*Assistant Examiner*—John Kreck
*Attorney, Agent, or Firm*—Roy, Kiesel & Tucker

[57] ABSTRACT

A mounting assembly is used to mount a printed circuit board on an oil tool. The assembly includes a flat surface on the oil tool. The flat surface is arranged to receive the printed circuit board. The assembly includes a clamp that is adapted to engage with peripheral edges of the printed board substantially around the periphery of the printed circuit board and to clamp the printed circuit board on the flat surface of the oil tool.

20 Claims, 3 Drawing Sheets

PRINTED CIRCUIT BOARD MOUNTING FOR OIL TOOLS

BACKGROUND OF THE INVENTION

The invention relates to mounting printed circuit boards on oil tools, such as mud pulse generators.

One technique used to drill a wellbore involves rotational drilling in which a drill string is rotated to actuate a drill bit at the remote end of the drill string. The rotating bit cuts through subterranean formations opening a path for the drill pipe that follows. Another technique involves using a motor, as opposed to rotating the drill string, to actuate the drill bit. The motor responds to drilling fluid that is forced through a central passageway of the drill string to the motor. The drilling fluid exits the motor and returns to the surface via an annular space, or annulus, that is located between the drill string and the wellbore.

It is usually desirable to obtain information about one or more downhole conditions as drilling progresses. For example, it may be desirable to know the wellbore inclination angle, wellbore magnetic heading and/or the tool-face orientation of the bottom-hole assembly to ensure that drilling is progressing in the right direction. Other useful information includes radioactivity of the formation to discriminate between sands and shale, resistivity and porosity of the formation to determine if oil is present.

These downhole conditions are typically measured by sensors located as near as possible to the bit. A downhole measurement while drilling (MWD) mud pulser transmits these measurements to the surface of the well by modulating the already present stream of drilling fluid that circulates down the central passageway of the drill string and up through the annulus. Sensor measurements are typically encoded in the stream by selectively restricting the flow of drilling fluid. As a result of these restrictions, the encoded data takes on the form of pressure pulses. Sensors at the surface of the well decode these pressure pulses to recover the downhole information from the mud stream.

SUMMARY OF THE INVENTION

In general, in one aspect, the invention features a mounting assembly for mounting a printed circuit board on an oil tool. The assembly includes a flat surface on the oil tool. The flat surface is arranged to receive the printed circuit board. The assembly includes a clamp that is adapted to engage with peripheral edges of the printed board substantially around the periphery of the printed circuit board and to clamp the printed circuit board on the flat surface of the oil tool.

Implementations of the invention may include one or more of the following. The assembly may include at least one insulator that is arranged on one side of the printed circuit board. The assembly may include a plurality of upstanding prongs that extend upwardly from the flat surface and are arranged to engage and align the insulator and the printed circuit board. The clamp may be generally semicircular and may be arranged for threaded engagement to the oil tool.

The assembly may include a plurality of upstanding members on either side of the flat surface. At least one of the upstanding members is adapted to allow electrical wires to extend into the flat surface containing the printed circuit board. At least one of the insulators may include a central opening. The insulator with a central opening may be made of a flexible insulating material. The insulator between the printed circuit board and the flat surfaces may be made of resilient material. The insulator with a central opening may be made of Teflon®.

In general, in another aspect, the invention features a method for mounting a printed circuit board on an oil tool. The method includes positioning the printed circuit board over a flat surface on the oil tool and clamping the peripheral edges of the printed circuit board to the oil tool.

Implementations of the invention may include one or more of the following. The method may also include the step of resiliently mounting the printed circuit board on the oil tool. The method may include aligning the printed circuit board on the oil tool using an upstanding tab on the oil tool and aligning the upstanding tab with an opening through the printed circuit board. The method may also include positioning an insulator above and below the printed circuit board. The method may include threadedly securing a cover over the insulators and securing the cover directly to the oil tool. The cover may be secured to the oil tool without threaded fasteners extending through the printed circuit board.

DESCRIPTION OF THE PREFERRED EMBODIMENTS

Figure 1:
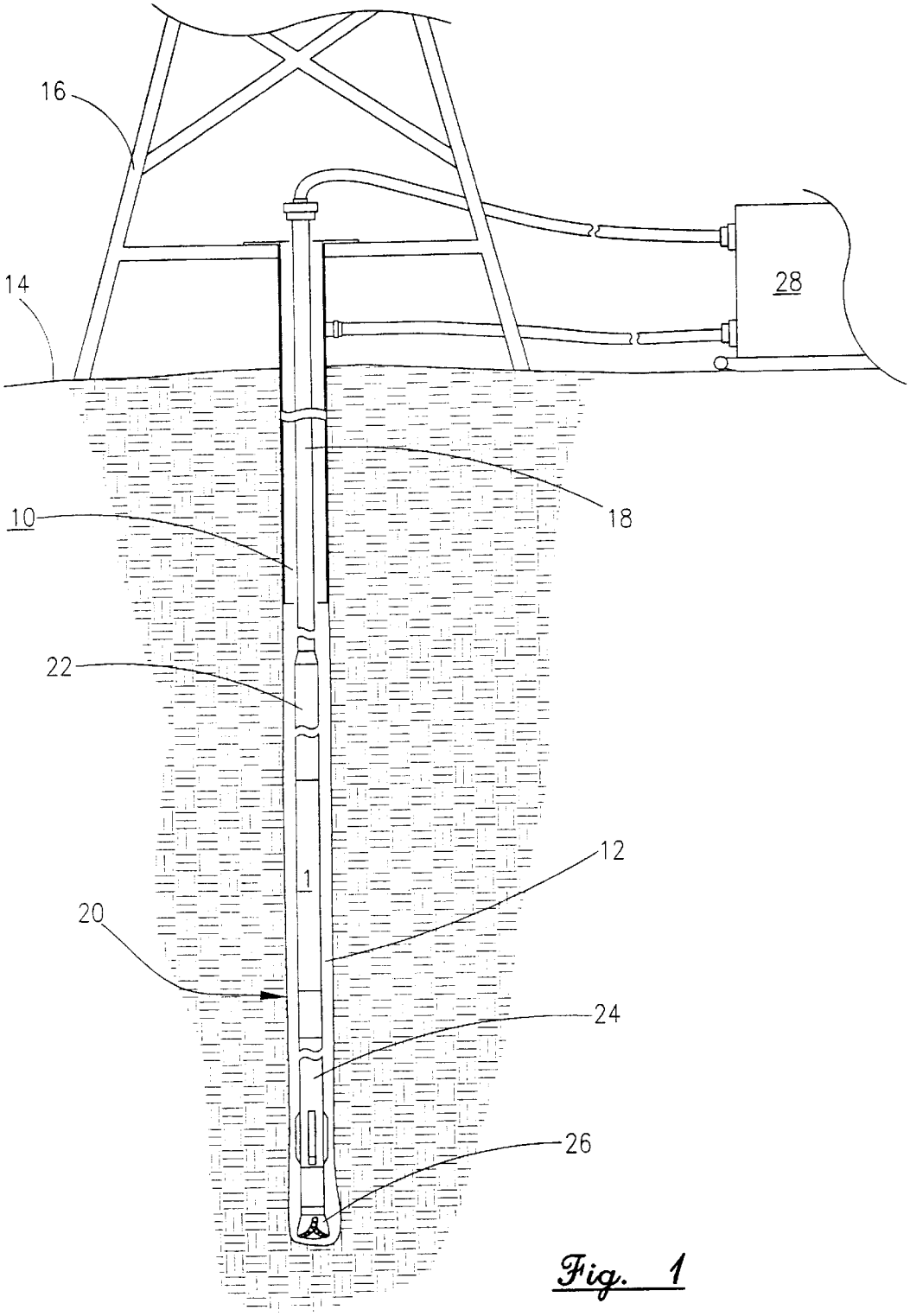
FIG. 1 is a schematic view of a drilling assembly.

Referring to the drawing wherein like reference characters are used for like parts throughout the several views, a drill string 10 (see FIG. 1) is suspended in a wellbore 12 and supported at the surface 14 by a drilling rig 16. The drill string 10 includes a drill pipe 18 coupled to a downhole tool assembly 20. The downhole tool assembly 20 includes multiple (e.g., twenty) drill collars 22, a measurement-while-drilling (MWD) tool assembly 1, a mud motor 24, and a drill bit 26. The drill collars 22 are connected to the drill string 10 on the uphole end of the drill collars 22, and the uphole end of the MWD tool assembly 1 is connected to the downhole end of the drill collars 22. The uphole end of the mud motor 24 is connected to the downhole end of MWD tool assembly 1. The downhole end of the mud motor 24 is connected to drill bit 26.

The drill bit 26 is rotated by the mud motor 24 which responds to the flow of drilling fluid, or mud, which is pumped from a mud tank 28 through a central passageway of the drill pipe 18, drill collars 22, MWD tool assembly 1 and then to the mud motor 24. The pumped drilling fluid jets out of the drill bit 26 and flows back to the surface through an annular region, or annulus, between the drill string 10 and the wellbore 12. The drilling fluid carries debris away from the drill bit 26 as the drilling fluid flows back to the surface. Shakers and other filters remove the debris from the drilling fluid before the drilling fluid is recirculated downhole.

The drill collars 22 provide a means to set weight off on the drill bit 26, enabling the drill bit 26 to crush and cut the formations as the mud motor 24 rotates the drill bit 26. As drilling progresses, there is a need to monitor various downhole conditions. To accomplish this, the MWD tool assembly 1 measures and stores downhole parameters and formation characteristics for transmission to the surface using the circulating column of drilling fluid. The downhole information is transmitted to the surface via encoded pressure pulses in the circulating column of drilling fluid.

Figure 2:
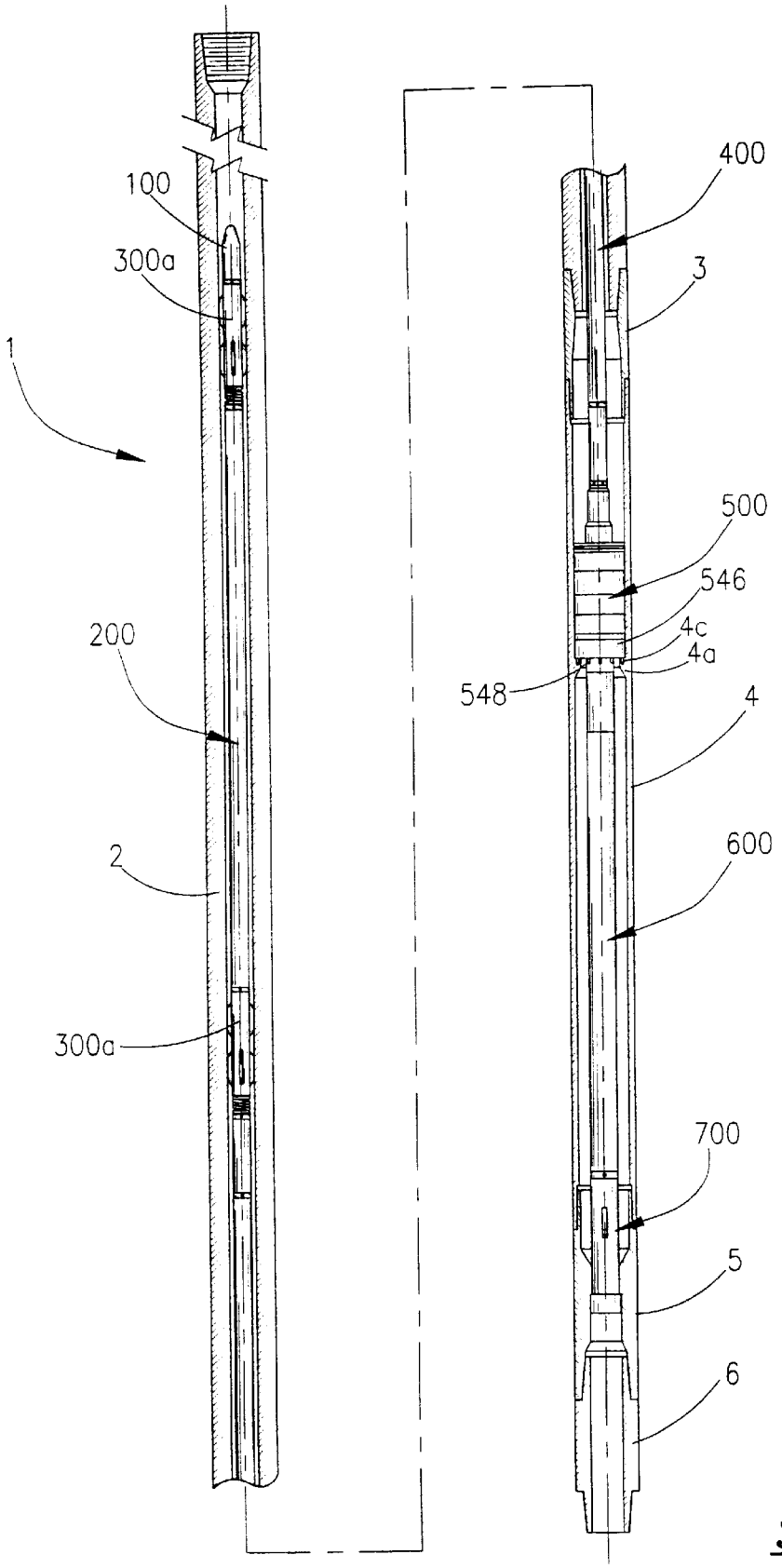
FIG. 2 is a vertical cross-sectional view of a portion of the drilling assembly of FIG. 1.

Referring to FIG. 2, from top to bottom, the components housed within the MWD tool assembly 1 include a bull plug 100, an upper rubber fin centralizer 300*a*, a survey measurement assembly 200, a lower rubber fin centralizer 300*b*, an interface assembly 400, a turbine assembly 500, an actuator assembly 600 and a valve assembly 700.

The bull plug 100 diverts the drilling fluid and protects the upper end of upper rubber fin centralizer 300*a*. The rubber fin centralizers 300*a* and 300*b* coaxially center the survey measurement assembly 200 and the interface assembly 400 that are housed within non-magnetic drill collar 2.

The survey measurement assembly 200 may include, for example, survey sensors, a microprocessor, microprocessor control program, and such additional supporting electrical circuitry (not shown) for producing electrical signals representative of downhole information that may be of interest. These electrical signals, via the interface assembly 400, control a spool valve within the actuator assembly. The spool valve controls the flow of hydraulic fluid to a rotary actuator, which in turn, controls a valve sleeve.

A chassis for a printed circuit board mounting assembly will be positioned within the interface assembly 400 seen in FIG. 2.

Figure 3:
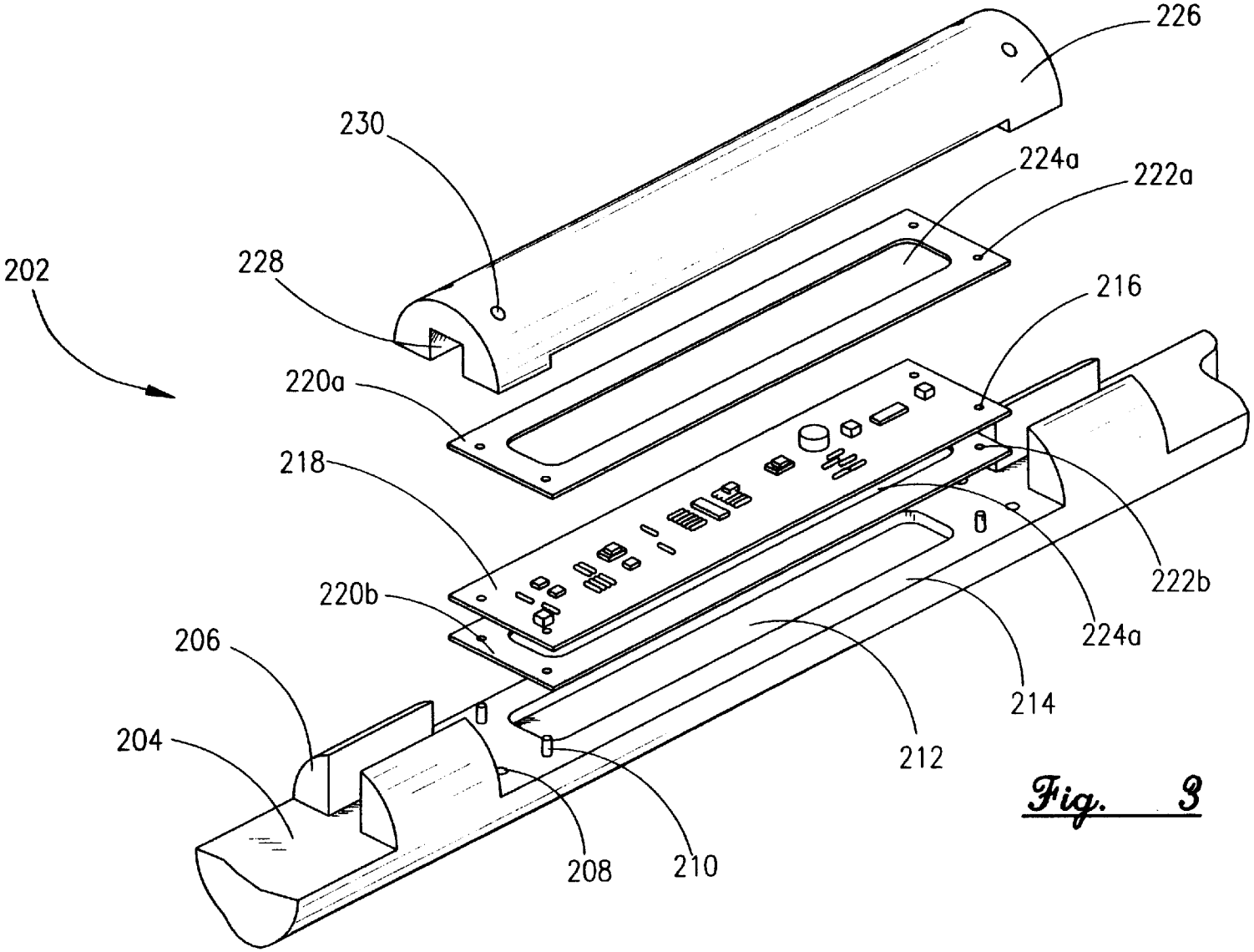
FIG. 3 is an explided perspective view of the circuit board assembly.

Referring to FIG. 3, a printed circuit board mounting assembly 202 is adapted to mount a printed circuit board 218 on the upper surface of a section 214*a* of a chassis 204. The chassis 204 includes two sets of upstanding quarter circular sections 206 which define between them a generally flat region 214 for receiving the printed circuit board 218. A plurality of upstanding guides 210 extend from the four corners of the region 214 to guide the printed circuit board into position on the surface 214. In addition, a plurality of screw holes 208 are adapted to receive screws (not shown).

A pair of electrical insulators 220*a* and 220*b* sandwich printed circuit board 218. The lower insulator 220*b* is a continuous sheet of insulating material such as a tetrafluroethylene substance such as that sold under the trademark TEFLON® with a plurality of apertures 222*b* alignable with apertures 216 in printed circuit board 218. Similarly, the insulator 220*a* includes apertures 222*a* which mate with the apertures 222*b* and 218 in the insulator 220*b* and the printed circuit board 218, respectively. Insulators 220*a* and 220*b* include an openings 224*a* and 224*b* to accommodate any electrical components which extend outwardly from the surface of the printed circuit board 218. Region 214 of chassis 204 includes a trough 212 corresponding to opening 224*a*. A semicircular cover 226 includes a plurality of screw holes 230 which mate with the holes 208 in surface 214. In addition, an opening 228 is provided to permit electrical wires to feed between the elements 206 and onto the printed circuit board 216.

When the assembly 202 is made up, the elements 220*a*, 218, and 220*b* are sandwiched on top of the surface 214 held in alignment by the upstanding pins 210. The whole assembly is sandwiched onto the surface 214 by the cover 226 which is threadedly connected by screws (not shown) to the surface 214. In this way, the printed circuit board 218 is uniformly clamped around its peripheral edge to the chassis 204 and no clamping force is applied to the area of circuit board 218 corresponding to trough 212. This peripheral clamping of the printed circuit board 218 serves to shift the mechanical modes of vibration of the printed circuit board and the components attached to the board to a higher frequency, into a frequency range where the energy available to excite the resonant modes of the printed circuit board and components is substantially reduced. Thus, the clamping of the printed circuit board reduces the effect of mechanical vibration which otherwise causes damage to the printed circuit board, solder joints and electrical components attached to the printed circuit board. Clamping the printed circuit board 216 serves to increase the useful life of the printed circuit board 216 and the components mounted thereon.

Other embodiments are within the scope of the following claims.

What is claimed is:

1. A mounting assembly for mounting a printed circuit board on an oil tool comprising:

a flat surface on said oil tool arranged to receive said printed circuit board; and a clamp adapted to engage with peripheral edges of said printed board substantially around said periphery of said printed circuit board such that clamping forces engage only said periphery of said printed circuit board in order to clamp said printed circuit board on said flat surface of said oil tool.

2. The assembly of claim 1 including at least one insulator arranged on either side of said printed circuit board.

3. The assembly of claim 2 including a plurality of upstanding pins extending upwardly from said flat surface and arranged to engage and align said insulator and said printed circuit board.

4. The assembly of claim 3 wherein said clamp has a generally semicircular cross section and has screw apertures for engagement to said oil tool.

5. The assembly of claim 4 including a plurality of upstanding members on either side of said flat surface, at least one of said upstanding members adapted to allow electrical wires to extend into the flat surface containing said printed circuit board.

6. The assembly of claim 5 wherein at least one of said insulators includes a central opening.

7. The assembly of claim 6 wherein said insulator with a central opening is made of a flexible insulating material.

8. The assembly of claim 7 wherein the insulator between said printed circuit board and said flat surfaces is made of resilient material.

9. The assembly of claim 8 wherein said insulator with a central opening is made of tetrafluroethylene.

10. A method for mounting a printed circuit board on an oil tool comprising:

positioning the printed circuit board over a flat surface on said oil tool; and clamping the peripheral edges of said printed circuit board to said oil tool such that clamping forces engage only said periphery of said printed circuit board.

11. The method of claim 10 including the step of resiliently mounting said printed circuit board on said oil tool.

12. The method of claim 11 including the steps of aligning said printed circuit board on said tool using an upstanding pin on said oil tool and aligning said upstanding pin with an opening through said printed circuit board.

13. The method of claim 12 including the step of positioning an insulator above and below said printed circuit board.

14. The method of claim 13, including the step of passing screws through screw apertures to threadedly secure a cover over said insulators, and secure said cover directly to said oil tool.

15. The method of claim 14 wherein said cover is secured to said oil tool without threaded fasteners extending through said printed circuit board.

16. A mounting assembly for mounting a printed circuit board on an oil tool comprising:

a flat surface on said oil tool arranged to receive said printed circuit board; and a clamp adapted to engage with peripheral edges of said printed board substantially around said periphery of said printed circuit board such that clamping forces engage only said periphery of said printed circuit board, thereby avoiding point loading caused by retaining said circuit board with screws which engage said circuit board.

17. The assembly of claim 16 including at least one insulator arranged on one side of said printed circuit board.

18. The assembly of claim 16 including a plurality of upstanding pins extending upwardly from said flat surface and arranged to engage and align said insulator and said printed circuit board.

19. The assembly of claim 16 wherein said insulator includes a central opening.

20. The assembly of claim 16 wherein said clamp has a generally semicircular cross section and has screw apertures for engagement to said oil tool.

* * * * *